United States Patent [19]

Moritz et al.

[11] 4,077,869

[45] Mar. 7, 1978

[54] INTEGRATED COKING AND GASIFICATION PROCESS

[75] Inventors: Karsten H. Moritz; Walter Weissman, both of Baton Rouge, La.

[73] Assignee: Exxon Research & Engineering Co., Linden, N.J.

[21] Appl. No.: 624,454

[22] Filed: Oct. 21, 1975

[51] Int. Cl.[2] ..... C10G 9/32

[52] U.S. Cl. ..... 208/127; 48/197 R; 201/17

[58] Field of Search ..... 208/127; 48/197 R; 201/17

[56] References Cited

U.S. PATENT DOCUMENTS

| | | | |
|---|---|---|---|
| 2,721,169 | 10/1955 | Mason et al. | 208/127 |
| 2,768,939 | 10/1956 | Mason et al. | 208/127 |
| 2,885,350 | 5/1959 | Brown et al. | 208/127 |
| 2,983,673 | 5/1961 | Grove | 201/17 |
| 3,007,849 | 11/1961 | Nelson et al. | 201/17 |
| 3,280,021 | 10/1966 | Metrailer et al. | 208/127 |
| 3,409,542 | 11/1968 | Molstedt | 208/127 |
| 3,661,543 | 5/1972 | Saxton | 208/127 |
| 3,694,346 | 9/1972 | Blaser et al. | 48/197 R |

*Primary Examiner*—Herbert Levine
*Attorney, Agent, or Firm*—Marthe L. Gibbons

[57] ABSTRACT

A low sulfur content coke is obtained in an integrated coking and gasification process wherein a portion or all of the steam reactant conventionally introduced into the gasification zone is replaced by a hydrogen-containing gas.

12 Claims, 1 Drawing Figure

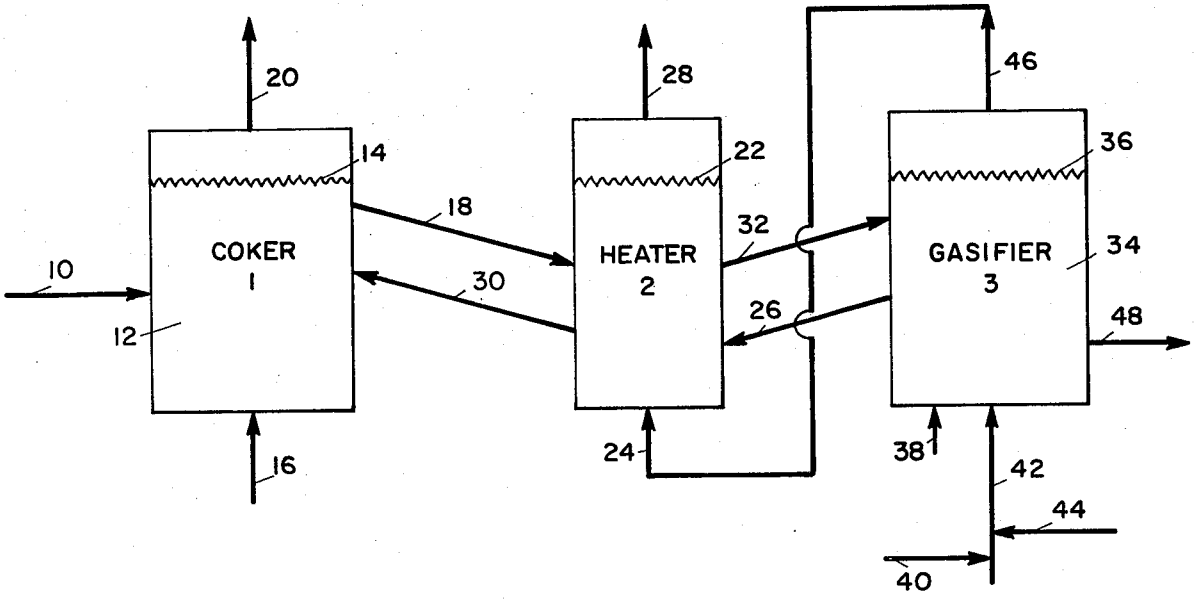
COKER
1
HEATER
2
GASIFIER
3
10
12
14
16
18
20
22
24
26
28
30
32
34
36
38
40
42
44
46
48

INTEGRATED COKING AND GASIFICATION PROCESS

BACKGROUND OF THE INVENTION

1. Field of the Invention

This invention relates to an integrated fluid coking and gasification process for the production of a low sulfur coke product.

2. Description of the Prior Art

It is known to produce fuel gases and low sulfur coke by integrated fluid coking and gasification processes, such as those disclosed in U.S. Pat. Nos. 3,661,543; 3,702,516; and 3,759,676, the teachings of which are hereby incorporated by reference. In these prior art processes, steam and an oxygen-containing gas are generally introduced into the bottom of the gasification zone to react with the coke present therein to produce a fuel gas and a low sulfur coke residue.

In the above-mentioned prior art processes, the operating severity in the gasifier (that is, bed height, temperature) is set by total unit heat balance considerations. Steam, broadly a flow of 10 to 30 mole percent steam (based on the total steam and air mixture) is normally added along with the air to the gasifier to aid in heat balance control. This mixture of air and steam enters the bottom zone (oxidation zone) of the gasifier where a portion of the coke is rapidly combusted to form predominately carbon dioxide. The resulting $N_2$, $CO_2$, $H_2O$ mixture then passes upwardly through the remainder of the gasifier (the reducing zone) where CO and $H_2$ are formed by reaction of $CO_2$ and $H_2O$ with coke. The degree of these reductions needs to be limited so as to keep the overall operation of the gasifier sufficiently exothermic to provide the heat requirements of the coker. This places an upper limit on gasifier severity. In order to maximize coke desulfurization, it is desirable to increase the severity in the gasifier beyond that set by overall heat balance considerations. One way to achieve this would be to reduce the quantity of steam to the gasifier; however, doing this alone would reduce steam and limit hydrogen partial pressure in the reducing zone and thereby reduce the rate of coke desulfurization.

It has now been found that the limitation on gasifier severity can be overcome without reducing the quantity of steam that enters the reducing zone of the gasifier by replacing all or a portion of the steam entering the gasifier with a gaseous fuel containing an amount of hydrogen equal to or greater than that which results from the replaced part of the steam. The hydrogen can be introduced into the gasifier either as molecular hydrogen or as hydrocarbons either of which produces steam in the lower oxidation zone of the gasifier. This steam is subsequently converted to molecular hydrogen in the reducing zone of the gasifier where it acts as desulfurization agent.

It is known to desulfurize carbonaceous materials such as coke by contacting the carbonaceous material with a hydrogen-containing gas at a hydrogen partial pressure ranging from 25 to 250 psig (39.7 psia to 264.7 psia), such as shown for example in U.S. Pat. No. 2,872,383.

SUMMARY OF THE INVENTION

In accordance with the invention there is provided, in an integrated coking and gasification process comprising the steps of (a) reacting a carbonaceous material containing sulfur contaminants, said carbonaceous material having a Conradson carbon content of at least 5 weight percent, in a coking zone containing a bed of fluidized solids maintained at a temperature ranging from about 850° to about 1,250° F. and at a pressure ranging up to about 164.7 pounds per square inch absolute (psia) to form coke containing sulfur contaminants, said coke depositing on said fluidized solids; (b) introducing a portion of said solids with the coke deposition thereon into a heating zone operated at a temperature greater than said coking zone temperature to heat said portion of solids; (c) recycling a first portion of heated solids from said heating zone to said coking zone and introducing a second portion of said heated solids to a fluid bed gasification zone maintained at a pressure ranging up to about 164.7 psia and at a temperature greater than the temperature of said heating zone and wherein an oxygen-containing gas and steam are introduced into said gasification zone, the improvement which comprises introducing a hydrogen-containing gas into said gasification zone to replace at least a portion of said steam, the total hydrogen partial pressure in said gasification zone (as measured at the gasifier outlet) ranging from about 4 to about 38 psia.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, a carbonaceous material having a Conradson carbon residue of about 15 weight percent such as a heavy residuum having a boiling point (at atmospheric pressure) of about 1050° F.+ is passed by line 10 into a coking zone 12 in which is maintained a fluidized bed of solids (e.g. coke particles of 40 to 1,000 microns in size) having an upper level indicated at 14. Carbonaceous feeds suitable for the present invention are heavy and reduced petroleum crudes, atmospheric distillation bottoms, vacuum distillation bottoms, pitch, asphalt, bitumen, other heavy hydrocarbon residua and mixtures thereof. Typically such feeds have a API gravity of about 0° to 20° and have a Conradson residue of at least 5 weight percent, generally from about 5 to about 50 weight percent, preferably above about 7 weight percent (as to Conradson carbon residue, see ASTM test D-189-65). A fluidizing gas, e.g. steam, is admitted at the base of the coking reactor through line 16 in an amount sufficient to obtain superficial fluidizing gas velocity in the range of 0.5 to 5 feet per second. Coke at a temperature above the actual coking temperature, for example, at a temperature from about 100° to about 800° F. in excess of the actual operating temperature of the coking zone, is admitted to the reactor by line 30 in an amount sufficient to maintain the coking temperature in the range of about 850° to about 1,250° F. The pressure in the coker is maintained in the range of up to about 164.7 pounds per square inch absolute (psia), preferably in the range of about 24.7 to about 114.7 psia, more preferably at a pressure not greater than about 59.7 psia. The lower portion of the coker serves as a stripping zone to remove occluded hydrocarbons from the coke. A stream of coke is withdrawn from the stripping zone by line 18 and circulated to heater 2. Conversion products are removed from the coker via line 20 for fractionation in a conventional manner.

In heater 2, stripped coke from coking reactor 1 (commonly called cold coke) is introduced by line 18 to a fluid bed of hot coke having an upper level indicated at 22. The bed may be partially heated by passing a fuel gas into the heater by line 24. Supplementary heat is supplied by coke circulating in line 26. The gaseous effluent of the heater is removed by line 28. Hot coke is removed from the fluidized bed in heater 2 and recycled to coking reactor 1 by line 30 to supply heat thereto. Another portion of coke is removed from heater 2 by line 32 and passed to a gasification zone 34 in gasifier 3 in which is maintained a bed of fluidized coke having a level indicated at 36.

The gasification zone is maintained at a temperature ranging from about 1,600° to about 2,000° F. and at a pressure ranging up to about 164.7 psia, preferably at a pressure ranging from about 34.7 to 89.7, more preferably at a pressure ranging from about 44.7 to about 74.7 psia.

An oxygen-containing gas, such as air or commercial oxygen via line 38 is passed into the bottom of the gasifier. A hydrogen-containing stream via line 40 is passed via line 42 into the gasifier. Optionally, steam via line 44 may be added to line 42. These streams may be preheated prior to introducing them into the gasifier by conventional means. Suitable hydrogen-containing stream for use in the gasifier include molecular hydrogen, refinery tail gases comprising hydrogen in major amounts with minor amounts of nitrogen and C1 to C4 hydrocarbons, sulfur containing hydrogen-rich fuel gases, sour hydrotreating tail gases, sour C2 minus coker gases and other refinery-produced sour tail gas streams containing $H_2$ and C1 to C4 hydrocarbons, and normally liquid hydrocarbons. In the lower portion of the gasifier, rapid combustion occurs whereby the gaseous constituents are converted to $H_2O$ and $CO_2$ with the remaining oxygen reacting with coke to produce predominantly $CO_2$. At least a portion of the steam is subsequently converted to hydrogen by reaction with carbon in the upper reducing zone of the gasifier. The hydrogen-containing gas can be introduced in sufficient amounts to replace all of the steam or to replace only a portion of the steam conventionally used as reactant in the gasification zone. By generating the steam in the gasifier from hydrogen-rich gases, a consistently higher hydrogen partial pressure can be achieved in the gasification reaction zone wihtin the confines of critical unit heat balance restraints than if the same amount of steam externally produced had been added to the gasifier. When steam is used in addition to the hydrogen-containing gas and to the oxygen-containing gas, the steam will comprise less than 30, preferably less than 10 mole percent based on the total mixture of gases introduced into the gasification zone.

The hydrogen-containing gas, either in the absence of steam or with added steam, will be introduced into the gasification zone in amounts sufficient to give a hydrogen partial pressure ranging from about 4 to about 38 psia, preferably from about 4 to about 25 psia, more preferably from about 4 to about 12 psia, as measured at the exit of the gasifier. It should be noted that at the exit of the gasifier, the total hydrogen content will include some hydrogen produced by devolatilization of the coke. The gaseous mixture introduced into the gasification zone maintains the coke particles fluidized and reacts with a portion of the coke to produce a fuel gas and a low sulfur coke. The fuel gas produced in the gasification zone is removed from gasifier 3 via line 46. If desired, the hot fuel gas may be passed via line 24 into heater 2. Alternatively, the fuel gas could be recovered from the gasifier without passing it through the heater. A low sulfur coke product, that is, a coke product having a lower sulfur content than the coke produced in the coker, is removed from the gasification zone via line 48. It should be noted that the low sulfur coke product produced in the gasifier could be removed from the process by removing a portion of the coke from the coke circulating in line 26 or the low sulfur coke product could be withdrawn from the heater but with some attendant debit in sulfur content.

The coke residence time in the gasifier bed will generally range from about 1 to about 8 hours, residence time being defined as weight of coke in the gasifier per weight per hour of total coke circulated to the gasifier.

What is claimed is:

1. In an integrated coking and gasification process comprising the steps of (a) reacting a heavy hydrocabonaceous oil containing sulfur contaminants, said heavy hydrocarbonaceous oil having a Conradson carbon content of at least 5 weight percent in a coking zone containing a bed of fluidized solids maintained at a temperature ranging from about 850° to about 1,250° F. and at a pressure ranging up to about 164.7 pounds per square inch absolute to form coke containing sulfur contaminants, said coke depositing on said fluidized solids;

(b) introducing a portion of said solids with the coke deposition thereon into a heating zone operated at a temperature greater than said coking zone temperature to heat said portion of solids;

(c) recycling a first portion of heated solids from said heating zone to said coking zone and introducing a second portion of said heated solids to a fluid bed gasification zone maintained at a pressure ranging up to about 164.7 psia and at a temperature ranging from about 1600° F. to about 2000° F. and wherein an oxygen-containing gas is introduced into said gasification zone, the improvement which comprises introducing a molecular hydrogen-containing gas into said gasification zone, the total hydrogen partial pressure in said gasification zone, as measured at the gasifier outlet, ranging from about 4 to about 38 psia.

2. The process of claim 1 wherein said hydrogen-containing gas comprises molecular hydrogen.

3. The process of claim 1 wherein said hydrogen-containing gas comprises hydrocarbons.

4. The process of claim 1 wherein the hydrogen partial pressure in said gasification zone, as measured at the exit of the gasifier, ranges from about 4 to about 25 psia.

5. The process of claim 1 wherein the hydrogen partial pressure in said gasification zone, as measured at the exit of the gasifier, ranges from about 4 to about 12 psia.

6. The process of claim 1 wherein the total pressure in said gasification zone ranges up to about 164.7 psia.

7. The process of claim 1 wherein the total pressure in said gasification zone ranges from about 34.7 to about 89.7 psia.

8. The process of claim 1 wherein the total pressure in said gasification zone ranges from about 44.7 to about 74.7 psia.

9. The process of claim 1 wherein said gasification is conducted in the absence of added steam.

10. The process of claim 1 wherein steam is also introduced into said gasification zone and wherein said steam comprises less than 30 mole percent based on the total gases introduced into said gasification zone.

11. The process of claim 1 wherein steam is also introduced into said gasification zone and wherein said steam comprises less than 10 mole percent based on the total gases introduced into said gasification zone.

12. The process of claim 1 wherein steam is also introduced into said gasification zone, said steam comprising less than 10 mole percent of the total gases introduced into said gasification zone and wherein the hydrogen partial pressure in said gasification zone, as measured at the gasifier outlet, ranges from about 4 to about 25 psia.

* * * * *